US008460472B2

(12) United States Patent
Takeshima et al.

(10) Patent No.: US 8,460,472 B2
(45) Date of Patent: Jun. 11, 2013

(54) METHOD FOR GLYCOSYLATING AND SEPARATING PLANT FIBER MATERIAL

(75) Inventors: Shinichi Takeshima, Numazu (JP); Takeshi Kikuchi, Sakura (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 377 days.

(21) Appl. No.: 12/995,809

(22) PCT Filed: Jun. 2, 2009

(86) PCT No.: PCT/IB2009/005927

§ 371 (c)(1),
(2), (4) Date: Dec. 2, 2010

(87) PCT Pub. No.: WO2009/147522

PCT Pub. Date: Dec. 10, 2009

(65) Prior Publication Data

US 2011/0105744 A1 May 5, 2011

(30) Foreign Application Priority Data

Jun. 3, 2008 (JP) ..... 2008-145732

(51) Int. Cl.
*C13K 1/02* (2006.01)

(52) U.S. Cl.
CPC ..... *C13K 1/02* (2013.01)
USPC ..... 127/37

(58) Field of Classification Search
USPC ..... 127/37
See application file for complete search history.

(56) References Cited

U.S. PATENT DOCUMENTS

| | | | |
|---|---|---|---|
| 2,959,500 | A | 11/1960 | Schlapfer et al. |
| 3,652,425 | A | 3/1972 | Wilson |
| 4,237,110 | A | 12/1980 | Forster et al. |
| 4,743,669 | A | 5/1988 | Young |
| 5,380,341 | A | 1/1995 | Matthews et al. |

(Continued)

FOREIGN PATENT DOCUMENTS

| | | |
|---|---|---|
| DE | 713610 | 11/1941 |
| EP | 1 860 201 A1 | 11/2007 |

(Continued)

OTHER PUBLICATIONS

S. Takeshima et al., U.S. Appl. No. 12/674,427, "Method of Saccharification and Separation for Plant Fiber Materials," filed Feb. 20, 2010.

(Continued)

*Primary Examiner* — David M Brunsman
(74) *Attorney, Agent, or Firm* — Finnegan, Henderson, Farabow, Garrett & Dunner, LLP

(57) ABSTRACT

The invention relates to a method for hydrolyzing a plant fiber material and producing and separating a saccharide including glucose. The method of the invention includes a hydrolysis process of using a cluster acid catalyst in a pseudo-molten state to hydrolyze cellulose contained in the plant fiber material and produce glucose. In the hydrolysis process, the cluster acid catalyst and a first amount of the plant fiber material that increases a viscosity of the cluster acid catalyst in a pseudo-molten state when added to the cluster acid catalyst in a pseudo-molten state are heated and mixed, and a second amount of the plant fiber material is then further added when the decrease in viscosity of the heated mixture occurs.

4 Claims, 2 Drawing Sheets

U.S. PATENT DOCUMENTS

| | | | | |
|---|---|---|---|---|
| 7,947,656 | B2 | 5/2011 | Yamasaki et al. | |
| 2010/0126501 | A1 | 5/2010 | Takeshima et al. | |
| 2010/0189706 | A1 | 7/2010 | Chang et al. | |
| 2011/0082291 | A1* | 4/2011 | Takeshima et al. | 536/128 |
| 2011/0105744 | A1* | 5/2011 | Takeshima et al. | 536/128 |
| 2011/0120454 | A1* | 5/2011 | Takeshima et al. | 127/37 |
| 2011/0180062 | A1* | 7/2011 | Takeshima et al. | 127/37 |
| 2011/0315138 | A1* | 12/2011 | Takeshima et al. | 127/37 |

FOREIGN PATENT DOCUMENTS

| | | | |
|---|---|---|---|
| JP | 56-30334 | A | 3/1981 |
| JP | 59-124901 | | 7/1984 |
| JP | 61-118420 | | 6/1986 |
| JP | 3-93755 | | 4/1991 |
| JP | 04-226940 | A | 8/1992 |
| JP | 7-41462 | | 2/1995 |
| JP | 8-299000 | | 11/1996 |
| JP | 10-137599 | | 5/1998 |
| JP | 10-327900 | | 12/1998 |
| JP | 11-240852 | | 9/1999 |
| JP | 11-343301 | | 12/1999 |
| JP | 2000-103758 | A | 4/2000 |
| JP | 2002-59118 | | 2/2002 |
| JP | 2004-241307 | | 8/2004 |
| JP | 2004-256370 | | 9/2004 |
| JP | 2006-129735 | | 5/2006 |
| JP | 2006-149343 | | 6/2006 |
| JP | 2006-206579 | | 8/2006 |
| JP | 4240138 | | 1/2009 |
| KR | 1996-0008643 | | 6/1996 |
| WO | WO 95/26438 | | 10/1995 |
| WO | WO 2006/011479 | A1 | 2/2006 |
| WO | WO 2008/132605 | A1 | 11/2008 |
| WO | WO 2009/031469 | A1 | 3/2009 |

OTHER PUBLICATIONS

K. Arai et al., "Hydrolysis of Cellulose Fiber in the Presence of 12-Tungstosilicic Acid," Journal of Applied Polymer Science, vol. 30, No. 7, pp. 3051-3057 (Jul. 1985).

K. Arai et al., "Hydrolyiis of Carbohydrates in the Presence of a Heteropolyacid," Makromol. Chem., Rapid Commun., vol. 4, pp. 181-185 (1983).

International Search Report in International Application No. PCT/IB2009/005927, Mailing Date: Aug. 25, 2009.

Written Opinion of the International Searching Authority in International Application No. PCT/IB2009/005927, Mailing Date: Aug. 25, 2009.

Notification of Reason(s) for Refusal in JP 2008-145732; Drafting Date: Jan. 7, 2010.

G.-W. Wang et al., "Phosphotungstic Acid Catalyzed Amidation of Alcohols," Eur. J. Org. Chem., pp. 4367-4371 (2008).

Notification of Reason(s) for Refusal dated Jan. 19, 2010 for Japanese Appl. No. JP 2008-145737.

Notification of Transmittal of the International Search Report and the Written Opinion of the International Searching Authority, or the Declaration, for PCT/IB2009/005928, dated Aug. 24, 2009.

Notification of Transmittal of the International Search Report and the Written Opinion of the International Searching Authority, or the Declaration, for PCT/IB2009/005920, dated Aug. 24, 2009.

Notification of Reason(s) for Refusal dated Jan. 19, 2010 for Japanese Appl. No. JP 2008-145741.

C. Yow et al., "Hydrolysis of Palm Olein Catalyzed by Solid Heteropolyacids," Journal of the American Oil Chemists' Society, vol. 79, No. 4, pp. 357-361 (2002).

Tong-hao, W. et al., "The Synthesis and Characterization of Molybdophosphoric Acid with Dawson Structure," 1991.

Kozhevnikov, I., "Catalysis by Heteropoly Acids and Multicomponent Polyoxometalates in Liquid-Phase Reactions," Chem. Rev., vol. 98, 1998, pp. 171-198.

Piao, D., et al., "An efficient partial oxidation of methane in trifluoracetic acid using vanadium-containing heteropolyacid catalysts,", Journal of Organometallic Chemistry, vol. 574, 1999, pp. 116-120.

International Search Report for PCT/IB2008/001528 dated Oct. 9, 2008.

Office Action dated Jan. 20, 2011 for U.S. Appl. No. 12/597,176.

Takeshima et al. U.S. Appl. No. 12/597,176, filed Oct. 23, 2009.

Takeshima et al. U.S. Appl. No. 12/995,784, filed Dec. 2, 2010.

Takeshima et al. U.S. Appl. No. 12/995,756, filed Dec. 2, 2010.

Office Action for U.S. Appl. No. 12/597,176 mailed Mar. 10, 2011.

Office Action issued by the U.S. Patent and Trademark Office in U.S. Appl. No. 12/995,784, mailed Apr. 25, 2012.

Decision of Refusal in Japanese Patent Appln. No. 2007-115407, dated May 17, 2011.

Notification of Reason(s) for Refusal in Japanese Patent Appln. No. 2007-115407, dated Aug. 23, 2011.

Makoto Misono, Unique acid catalysis of heteropoly compounds (heteropolyoxometalates) in the solid state, Chem. Commun., Jul. 7, 2001, No. 13 pp. 1141-1152.

Toru Nishimura, et al., High Catalytic Activities of Pseudoliquid Phase of Dodecatungstophosphoric Acid for Reactions of Polar Molecules, Chemistry Letters, 1991, pp. 1695-1698.

Makoto Misono, et al., Solid superacid catalysts, Chemtech, Nov. 1993, pp. 23-28.

Toko Kengaku, et al., Michael addition in the pseudoliquid phase of heteropoly compounds, Journal of molecule Catalysis A: Chemical 134, 1998, pp. 237-242.

Toshio Okuhara, et al., Catalysis by Heteropoly Compounds, Journal of Catalysis 93, 1985, pp. 224-230.

Office Action dated Jan. 9, 2012, for U.S. Appl. No. 12/597,176.

Reply to Office Action filed Jun. 9, 2011 in U.S. Appl. No. 12/597,176.

Makoto Misono, et al., Solid superacid catalysts, Chemtech, Nov. 1993, pp. 23-29.

* cited by examiner

METHOD FOR GLYCOSYLATING AND SEPARATING PLANT FIBER MATERIAL

CROSS-REFERENCE TO RELATED APPLICATIONS

This application is a national phase application of International Application No. PCT/IB2009/005927, filed Jun. 2, 2009, and claims the priority of Japanese Application No. 2008-145732, filed Jun. 3, 2008, the contents of both of which are incorporated herein by reference.

BACKGROUND OF THE INVENTION

1. Field of the Invention

The invention relates to a method for producing a saccharide including glucose, by glycosylating a plant fiber material and separating the obtained saccharide.

2. Description of the Related Art

It has been suggested to produce a saccharide mainly including glucose or xylose, from cellulose or hemicellulose by degrading a plant material, which is a biomass, such as squeezed sugarcane residues (bagasse) or wood chips and effectively use the produced saccharide as food or fuel, and this process has been put into practice. In particular, a technology by which a monosaccharide obtained by degrading plant fibers is fermented to produce an alcohol such as ethanol as fuel has attracted attention. A variety of methods have been heretofore suggested for producing a saccharide such as glucose by degrading cellulose or hemicellulose (for example, Japanese Patent Application Publication No. 8-299000 (JP-A-8-299000), Japanese Patent Application Publication No. 2006-149343 (JP-A-2006-149343), Japanese Patent Application Publication No. 2006-129735 (JP-A-2006-129735), and Japanese Patent Application Publication No. 2002-59118 (JP-A-2002-59118)). A typical method includes hydrolyzing cellulose enzyme by using sulfuric acid such as dilute sulfuric acid or concentrated sulfuric acid or hydrochloric acid (JP-A-8-299000). A method in which cellulase is used (JP-A-2006-149343), a method in which a solid catalyst such as activated carbon or zeolite is used (JP-A-2006-129735), and a method in which pressurized hot water is used (JP-A-2002-59118) are also available.

However, a problem associated with the method by which cellulose is degraded by using an acid such as sulfuric acid is that the acid serving as a catalyst and the produced saccharide are difficult to separate from the hydrolysis reaction mixture obtained by hydrolysis. This is because glucose that is the main component of the cellulose hydrolysis product and the acid that serves as a hydrolysis catalyst are both soluble in water. Removal of the acid by neutralization or ion exchange from the hydrolysis reaction mixture is not only troublesome and costly, but it is also difficult to remove the acid completely and the acid often remains in the process of fermentation for ethanol. As a result, even when pH is optimized from the standpoint of activity of yeast in the process of fermentation for ethanol, concentration of salt increases, thereby reducing the yeast activity and decreasing the fermentation efficiency.

In particular, when concentrated sulfuric acid is used, the sulfuric acid is very difficult to remove to the extent such that yeast is not deactivated in the process of fermentation for ethanol and such a removal requires significant energy. By contrast, when dilute sulfuric acid is used, the sulfuric acid is relatively easy to remove. However, it is necessary to degrade cellulose under high temperature conditions, which is energy consuming. Yet another problem arising when a concentrated sulfuric acid is used is that where the reaction is conducted for a long time, the produced saccharide is dehydrated and the yield of saccharide decreases. As a result, even when a plant fiber material is added to the reaction system during hydrolysis to increase the amount of the plant fiber material subjected to hydrolysis, the yield of saccharide related to the plant fiber material does not increase. In addition the acid such as sulfuric acid and hydrochloric acid is very difficult to separate, collect, and reuse. Thus, the use of these acids as a catalyst for producing glucose is a cause of increased cost of bio-ethanol.

With the method in which pressurized hot water is used, it is difficult to adjust the conditions, and it is difficult to produce glucose with a stable yield. In addition, in this method, even glucose is degraded, thereby reducing the yield of glucose. Moreover, the activity of yeast is reduced by degraded components and fermentation may be inhibited. Another problem is associated with cost because the reactor (supercritical processing apparatus) is expensive and has poor durability.

SUMMARY OF THE INVENTION

The inventors have conducted a comprehensive study of glycosylation of cellulose and have discovered that a cluster acid in a pseudo-molten state has excellent catalytic activity with respect to cellulose hydrolysis and can be easily separated from the produced saccharide. Patent applications that cover the respective method have already been filed (Japanese Patent Application No. 2007-115407 and Japanese Patent Application No. 2007-230711). According to the present method, by contrast with the conventional method using concentrated sulfuric acid or dilute sulfuric acid, the hydrolysis catalyst can be recovered and reused and energy efficiency of the process leading to the recovery of aqueous saccharide solution and recovery of hydrolysis catalyst from cellulose hydrolysis can be increased. Furthermore, in the method of the aforementioned patent applications the cluster acid in a pseudo-molten state acts as a hydrolysis catalyst and also acts as a reaction solvent.

The inventors have further advanced the research of cellulose glycosylation using the cluster acid catalyst and have successfully increased the processed amount of plant fiber material per unit weight of the cluster acid catalyst. Thus, the invention is based on the results obtained in the course of this research and provides a method for glycosylating and separating a plant fiber material by using the cluster acid catalyst in a pseudo-molten state, in which the processed amount of plant fiber material per unit weight of the cluster acid catalyst is increased, the amount of the cluster acid catalyst used is decreased, and energy efficiency is increased.

The first aspect of the invention relates to a method for hydrolyzing a plant fiber material and producing and separating a saccharide including glucose. This method includes a hydrolysis process of using a cluster acid catalyst in a pseudo-molten state to hydrolyze cellulose contained in the plant fiber material and produce glucose. In the hydrolysis process, the cluster acid catalyst and a first amount of the plant fiber material that increases a viscosity of the cluster acid catalyst in a pseudo-molten state when added to the cluster acid catalyst in a pseudo-molten state are heated and mixed, and a second amount of the plant fiber material is then further added when the decrease in viscosity of a heated mixture the cluster acid catalyst and the first amount of the plant fiber material occurs. The first amount and the second amount may be identical.

In Japanese Patent Application No. 2007-115407 and Japanese Patent Application No. 2007-230711, the inventors disclosed a method for glycosylating and separating a plant fiber material in which a cluster acid is heated to obtain a pseudo-molten state and used as a hydrolysis catalyst for the plant fiber material. In this method or glycosylating and separating, the cluster acid in a pseudo-molten state acts as a hydrolysis catalyst and also acts as a reaction solvent for hydrolysis. For this reason, the mixing ratio of the cluster acid catalyst and plant fiber material in the hydrolysis process is determined so as to ensure miscibility of the cluster acid catalyst and plant fiber material. In other words, the amount of plant fiber material that can be mixed in one cycle with the cluster acid catalyst is limited, and the processed amount of the plant fiber material per unit weight of the cluster acid catalyst is also limited.

The results of the investigation conducted by the inventors demonstrated that in the method for glycosylating and separating a plant fiber material by using a cluster acid catalyst, where the plant fiber material is charged in a plurality of cycles, as described hereinabove, when the cluster acid catalyst and plant fiber material are stirred under heating and the plant fiber material is hydrolyzed, the processed amount for the plant fiber material per unit weight of the cluster acid catalyst is increased. Thus, initially, the cluster acid catalyst and the amount of the plant fiber material that is added to increase the viscosity are heated and mixed and hydrolysis of the plant fiber material is started. Then, when the viscosity of the heated mixture in which the plant fiber material has been hydrolyzed is decreased, the plant fiber material is further added. Thus it was found that the heated mixture of the cluster acid catalyst in a pseudo-molten state and the plant fiber material has a high viscosity at the initial stage of the hydrolysis reaction, but the viscosity decreases as the hydrolysis of the plant fiber material advances. Furthermore, it was discovered that because of the decreased viscosity of the heated mixture, even when the plant fiber material is charged anew in the heated mixture, the heated mixture still can be mixed and stirred and both the initially charged plant fiber material and the further added plant fiber material can be hydrolyzed, while ensuring a high saccharide yield. In other words, in accordance with the invention, the processed amount of the plant fiber material can be increased by the amount of plant fiber material that is further added compared with the conventional one. As a result, the processed amount of the plant fiber material per unit weight of the cluster acid catalyst is increased and a cost reduction effect in saccharide production is obtained due to the decrease in the amount of cluster acid catalyst used. Furthermore, because the plant fiber material is further added into the heated mixture in the catalyst process that includes the cluster acid catalyst in a pseudo-molten state, the energy required for heating that is necessary to obtain the pseudo-molten state of the cluster acid catalyst can be decreased. Thus, energy efficiency can be increased. The extent of reduction in the heated mixture viscosity at which the plant fiber material is further added may be appropriately determined according to the amount of the plant fiber material that will be further added. Thus, where a small amount is to be further added, it can be charged after a relatively small decrease in viscosity, but where a large amount is to be charged, the plant fiber material is not added till the hydrolysis reaction advances sufficiently and the viscosity decreases significantly. In any case, it is preferred that the plant fiber material be further added so as not to exceed the viscosity attained after the initial addition of the fiber material.

An indicator of the period when the second amount of the plant fiber material is to be further added can be, for example, a time when the viscosity of the heated mixture decreases to or below 1500 cp.

A volume ratio of the first amount of the plant fiber material to the cluster acid catalyst can be equal to or greater than 60%. A volume ratio of the amount of the plant fiber material that is added thereafter to the cluster acid catalyst can be equal to or greater than 60%.

In accordance with the invention, in the method for glycosylating and separating a plant fiber material by using a cluster acid catalyst in a pseudo-molten state, it is possible to increase the hydrolyzed amount of the plant fiber material per unit weight of the cluster acid catalyst, decrease the amount of cluster acid used, and increase energy efficiency. Therefore, in accordance with the invention, cost and energy consumption in the production of saccharide by hydrolysis of a plant fiber material can be reduced.

The second aspect of the invention relates to a method for hydrolyzing a plant fiber material and producing and separating a saccharide including glucose. The method includes a hydrolysis process of using a cluster acid catalyst in a pseudo-molten state to hydrolyze cellulose contained in the plant fiber material and produce glucose. In the hydrolysis process, the plant fiber material is added when a viscosity of a mixture of the cluster acid catalyst and the plant fiber material becomes a first predetermined value, and then the addition of the plant fiber material is stopped when the viscosity of the mixture becomes a second predetermined value that is larger than the first predetermined value.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF EMBODIMENTS

Figure 1:
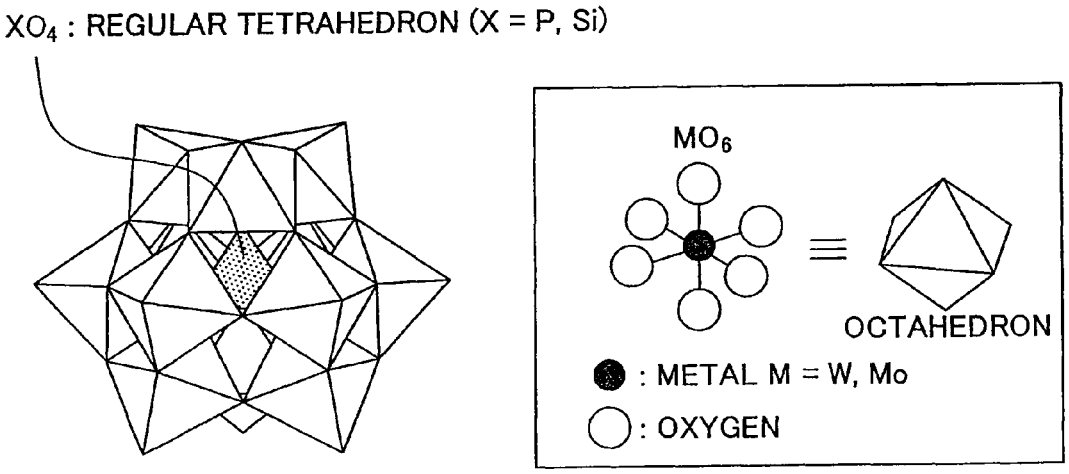
FIG. 1 shows a Keggin structure of a heteropoly acid.

A method for glycosylating and separating a plant fiber material that is an embodiment of the invention will be described below. First, a hydrolysis process will be described in which cellulose contained in the plant fiber material is hydrolyzed and a saccharide mainly including glucose is produced. In the explanation below, the attention is focused on the process in which glucose is mainly produced from cellulose, but a process in which hemicellulose is included in addition to cellulose in the plant fiber material and a process in which the product includes other monosaccharides such as xylose in addition to glucose also fall within the scope of the invention.

The plant fiber material is not particularly limited, provided that it includes cellulose or hemicellulose, and examples thereof include cellulose-based biomass, such as broad-leaved trees, bamboos, coniferous trees, kenaf, scrap wood from furniture, rice straws, wheat straws, rice husks, and squeezed sugarcane residues (bagasse). The plant fiber material may be the cellulose or hemicellulose that is separated from the biomass, or may be the cellulose or hemicellulose that is artificially synthesized. Such fiber materials are usually used in the pulverized form to improve dispersivity in the reaction system. The method for pulverizing may be a commonly used method. From the standpoint of facilitating mixing with the cluster acid catalyst and reaction, it is preferred that the plant fiber material be pulverized to a powder with a diameter of about a few microns to 200 μm.

Lignin contained in the fiber material may be dissolved, if necessary, by performing a pulping treatment in advance. The amount of residue during glycosylation and separation can be reduced by dissolving and removing the lignin, the produced saccharide or cluster acid can be prevented from mixing with the residue, and reduction in the saccharide yield or cluster acid recovery ratio can be inhibited. In a case where the pulping treatment is performed, the degree of grinding of the plant fiber material can be comparatively small (coarse grinding). The resultant effect is that labor, cost, and energy required for pulverizing the fiber material can be reduced. The pulping treatment can be performed, for example, by bringing the plant fiber material (for example, from several centimeters to several millimeters) into contact with an alkali or a salt such as NaOH, KOH, $Ca(OH)_2$, $Na_2SO_3$, $NaHCO_3$, $NaHSO_3$, $Mg(HSO_3)_2$, $Ca(HSO_3)_2$, an aqueous solution thereof, a mixture thereof with a $SO_2$ solution, or a gas such as $NH_3$ under steam. Specific conditions include a reaction temperature of 120 to 160° C. and a reaction time of several tens of minutes to about 1 h.

In accordance with the invention, the cluster acid used as a catalyst for hydrolyzing the plant fiber material means an acid in which a plurality of oxoacids are condensed, that is, a so-called polyacid. In most polyacids, a plurality of oxygen atoms are bounded to a central element. As a result, the polyacids are known to be mostly in a state of oxidation to the maximum oxidation number, demonstrate excellent properties as an oxidation catalyst, and be strong acids. For example, the acid strength of phosphotungstic acid (pKa=−13.16), which is a heteropoly acid, is higher than the acid strength of sulfuric acid (pKa=−11.93). Thus, even under mild temperature conditions, such as a temperature of 50° C., for example, it is possible to degrade cellulose or hemicellulose to produce a monosaccharide, such as glucose or xylose.

The cluster acid used in the invention may be either a homopoly acid or a heteropoly acid, but a heteropoly acid is preferred because it has a high oxidizing power and a high acid strength. The heteropoly acid that can be used is not particularly limited. For example, the heteropoly acid can be represented by the general formula HwAxByOz (A stands for a heteroatom, B stands for a polyatom that serves as a polyacid skeleton, w stands for a composition ratio of hydrogen atoms, x stands for a composition ratio of heteroatoms, y stands for a composition ratio of polyatoms, and z stands for a composition ratio of oxygen atoms). Examples of the polyatom B include atoms such as W, Mo, V, and Nb that can form the polyacid. Examples of the heteroatom A include atoms such as P, Si, Ge, As, and B that can form a heteropoly acid. The number of kinds of the polyatoms and heteroatoms that are contained in a single molecule of the heteropoly acid may be one or more.

Because of good balance of acid strength and the oxidizing power, it is preferred that phosphotungstic acid $H_3[PW_{12}O_{40}]$ or silicotungstic acid $H_4[SiW_{12}O_{40}]$, which are tungstates, be used. Phosphomolybdic acid $H_3[PMo_{12}O_{40}]$, which is a molybdate, also can be advantageously used.

The structure of a Keggin-type $[X''^{+}M_{12}O_{40}$: X=P, Si, Ge, As, etc., M=Mo, W, etc.] heteropoly acid (phosphotungstic acid) is shown in FIG. 1. A tetrahedron $XO_4$ is present at the center of a polyhedron constituted by octahedron $MO_6$ units, and a large amount water of crystallization is present around this structure. The structure of the cluster acid is not particularly limited and can be not only of the Keggin type, but also, for example, of a Dawson type. Here water that is hydrated or coordinated to the cluster acid catalyst in a crystalline state or the cluster acid catalyst in a cluster state constituted by several molecules of the cluster acid catalyst is described by a generally used term "water of crystallization". The water of crystallization includes anion water that is hydrogen bonded to the anion constituting the cluster acid catalyst, coordination water that is coordinated to the cation, lattice water that is not coordinated to the cation or anion, and also water that is contained in the form of OH groups. The cluster acid catalyst in a cluster state is an association constituted by one to several molecules of cluster acids and is different from a crystal. The cluster acid catalyst in a cluster state can be in a solid state, a pseudo-molten state, and in a state of dissolution in a solvent (colloidal state).

In the hydrolysis process of the glycosylating and separating method in accordance with the invention, the plant fiber material is divided and added in cycles. Therefore, the monosaccharide that has been produced from the plant fiber material that was charged at the beginning of the hydrolysis process is heated and continuously mixed with the cluster acid catalyst together with the additionally charged plant fiber material. Therefore, the occurrence of monosaccharide dehydration reaction (hyperreaction) is inhibited, thereby making it possible to increase the yield of monosaccharide. From this standpoint, it is preferred that a catalyst in a cluster state that has an acid strength suitable for hydrolysis of cellulose be used as the cluster acid catalyst. Because a cluster acid in a cluster state hardly induces hyperreaction of monosaccharides, the monosaccharide yield does not decrease even in long-term heating of the cluster acid with the monosaccharide. A method for preparing the cluster acid catalyst in a cluster state is not particularly limited. A specific method therefor will be described below.

The above-described cluster acid catalyst is in a solid state at normal temperature, but becomes a pseudo-molten state when heated to a higher temperature. The pseudo-molten state as referred to herein means a state in which the cluster acid is apparently melted but is not completely melted into a liquid state; the pseudo-molten state resembles a colloidal (sol) state in which the cluster acid is dispersed in a liquid, and is a state in which the cluster acid shows fluidity. Whether the cluster acid is in the pseudo-molten state can be confirmed by visual observations, or in the case of a homogeneous system, by DTG (Differential Scanning Calorimetry). The pseudo-molten state of the cluster acid changes depending on temperature and amount of water of crystallization contained in the cluster acid catalyst (see FIG. 2). More specifically, where the amount of water of crystallization contained in phosphotungstic acid, which is a cluster acid, is high, the temperature at which the acid demonstrates a pseudo-molten state decreases. Thus, a cluster acid catalyst containing a large amount of water of crystallization demonstrates a catalytic effect on the cellulose hydrolysis reaction at a temperature lower than that of the cluster acid catalyst with a relatively small amount of water of crystallization. In other words, by controlling the amount of water of crystallization contained in the cluster acid catalyst in the reaction system of the hydrolysis process, it is possible to bring the cluster acid catalyst into a pseudo-molten state at the target hydrolysis reaction temperature. For example, when phosphotungstic acid is used as the cluster acid catalyst, it is possible to control the hydrolysis reaction temperature within the range between 40 and 110° C. by changing the amount of water of crystallization in the cluster acid (see FIG. 2).

Figure 2:
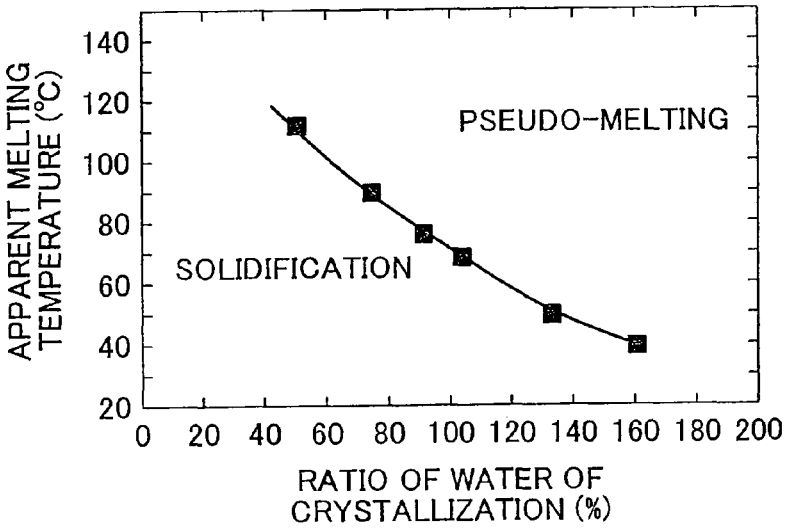
FIG. 2 is a graph showing a relationship between the ratio of water of crystallization in a cluster acid catalyst and apparent melting temperature.

FIG. 2 shows a relationship between the ratio of water of crystallization in the heteropoly acid (phosphotungstic acid), which is a typical cluster acid catalyst, and the temperature (apparent melting temperature) at which the pseudo-molten state is first demonstrated. The cluster acid catalyst is in a solid state in the region under the curve, and in a pseudo-molten state in the region above the curve. Furthermore, in FIG. 2, the ratio of water of crystallization (%) is a value obtained under the assumption that a standard amount of water of crystallization n (n=30) in the cluster acid (phosphotungstic acid) is 100%. Because no component of cluster acid catalyst is thermally decomposed and volatilized even at a high temperature such as 800° C., the amount of water of crystallization can be specified by a pyrolytic method (TG measurements).

The standard amount of water of crystallization as referred to herein is the amount (the number of molecules) of water of crystallization contained in a molecule of the cluster acid in a solid state at room temperature, and the standard amount varies depending on the kind of cluster acid. For example, the standard amount of water of crystallization is about 30 in phosphotungstic acid ($H_3[PW_{12}O_{40}].nH_2O$ (n≈30)), about 24 in silicotungstic acid ($H_4[SiW_{12}O_{40}].nH_2O$ (n≈24)), and about 30 in phosphomolybdic acid ($H_3[PMo_{12}O_{40}].nH_2O$ (n≈30)).

The amount of water of crystallization contained in the cluster acid catalyst can be regulated by controlling the amount of water present in the hydrolysis reaction system. Specifically, when it is desired to increase the amount of water of crystallization contained in the cluster acid catalyst, that is, to lower the reaction temperature, it is possible to add water to the hydrolysis reaction system by adding water to the mixture containing the plant fiber material and the cluster acid catalyst or by raising the relative humidity of the atmosphere of the reaction system. As a result, the cluster acid takes in the added water as water of crystallization, and the apparent melting temperature of the cluster acid catalyst is lowered.

By contrast, when it is desired to reduce the amount of water of crystallization contained in the cluster acid catalyst, that is, to raise the reaction temperature, it is possible to reduce the amount of water of crystallization contained in the cluster acid catalyst by removing water from the hydrolysis reaction system, for example, by heating the reaction system to evaporate water, or adding a desiccant agent to the mixture containing the plant fiber material and the cluster acid catalyst. As a result, the apparent melting temperature of the cluster acid catalyst is raised. As described above, it is possible to control easily the amount of water of crystallization contained in the cluster acid, and it is also possible to regulate easily the reaction temperature at which cellulose is hydrolyzed, by controlling the amount of water of crystallization.

As described above, the cluster acid exhibits a high catalytic activity to the hydrolysis of cellulose even at low temperatures due to a high acid strength of the cluster acid. Because the diameter of a molecule of the cluster acid is about 1 to 2 nm, typically slightly larger than 1 nm, the cluster acid is easily mixed with the plant fiber material, which is the raw material, and therefore efficiently promotes hydrolysis of cellulose. Thus, it is possible to hydrolyze cellulose under mild temperature conditions with high energy efficiency and low environmental load. In addition, by contrast with the conventional method for hydrolysis of cellulose that uses an acid such as sulfuric acid, the method in accordance with the invention that uses a cluster acid as a catalyst, the separation efficiency of the saccharide and catalyst is high and they can be easily separated. Because the cluster acid is in a solid state at a certain temperature, it can be separated from the saccharide, which is the product. Therefore, the separated cluster acid can be recovered and reused. Furthermore, because the cluster acid catalyst in a pseudo-molten state also functions as a reaction catalyst, the amount of solvent used as the reaction solvent can be greatly reduced by comparison with that of the conventional method. It means that separation of the cluster acid and the saccharide, which is the product, and the recovery of the cluster acid can be performed at an increased efficiency. Thus, the invention in which the cluster acid is used as the cellulose hydrolysis catalyst can reduce cost and decrease environmental load.

In accordance with the invention, in the hydrolysis process in which a plant fiber material is hydrolyzed and a saccharide is produced by using a cluster acid catalyst in a pseudo-molten state, the cluster acid catalyst and an amount of the plant fiber material that increases a viscosity of the cluster acid catalyst in a pseudo-molten state when added to the cluster acid catalyst in a pseudo-molten state are heated and mixed, thereby advancing the hydrolysis of the plant fiber material, and the plant fiber material is then additionally charged after the viscosity of the heated mixture has decreased.

In this case, the amount of the plant fiber material that increases a viscosity of the cluster acid catalyst in a pseudo-molten state when added to the cluster acid catalyst in a pseudo-molten state, as referred to herein, is the amount that increases the viscosity when the cluster acid catalyst used in the hydrolysis process is in a pseudo-molten state and the plant fiber material is added to the cluster acid catalyst in a pseudo-molten state over the viscosity of the cluster acid catalyst in a pseudo-molten state before the addition of the plant fiber material. The specific amount of the plant fiber material differs depending on the properties of the plant fiber material used (size, shape, pore structure, and the like) and heating temperature, stirring (kneading) state, and temperature distribution during mixing of the plant fiber material cluster acid catalyst in a pseudo-molten state and the plant fiber material. Therefore, the specific amount can be appropriately determined in advance. Usually, where the volume ratio of the plant fiber material to the cluster acid catalyst used in the hydrolysis process is equal to or higher than 60%, the viscosity rises when the plant fiber material is added to the cluster acid catalyst in a pseudo-molten state. In particular, from the standpoint of processing efficiency of the plant fiber material, it is preferred that the volume ratio of the plant fiber material to the cluster acid catalyst used in the hydrolysis process be equal to or higher than 50%, even more preferably equal to or higher than 65%.

The sequence in which the cluster acid catalyst and plant fiber material are charged into a reaction container is not particularly limited. For example, the cluster acid catalyst may be charged and heated to obtain a pseudo-molten state, and then the plant fiber material may be charged. Alternatively, the cluster acid catalyst and plant fiber material may be charged together and then heated to bring the cluster acid catalyst into a pseudo-molten state. In a case where the cluster acid catalyst and plant fiber material are heated after charging, the cluster acid catalyst and plant fiber material are preferably mixed and stirred in advance, prior to heating. The degree of contact between the cluster acid and plant fiber material can be increased by conducting mixing to a certain degree before the cluster acids is brought into a pseudo-molten state.

As described hereinabove, because the cluster acid catalyst becomes a pseudo-molten state and functions as a reaction catalyst in the hydrolysis process, in accordance with the invention, it is possible to use no water or organic solvent as a reaction solvent in the hydrolysis process, but water or organic solvent may be required depending on the form (size, state of fibers, etc.) of the plant fiber material, mixing ratio and volume ratio of the cluster acid catalyst and plant fiber material, and the like. However, water is necessary for hydrolyzing cellulose in the hydrolysis process. More specifically, (n-1) molecules of water are required to degrade cellulose in which (n) glucoses have been polymerized into (n) glucoses (n is a natural number). Therefore, in a case where a sum total of the amount of water of crystallization that is necessary to bring the cluster acid into a pseudo-molten state at the reaction temperature and the amount of water necessary to hydrolyze the entire charged amount of cellulose into glucose is not present in the reaction system, the water of crystallization of the cluster acid catalyst is used for hydrolysis of cellulose, the amount of water of crystallization of the cluster acid catalyst decreases, and the cluster acid solidifies. Thus, the degree of contact between the cluster acid catalyst and the plant fiber material or the viscosity of the mixture of the plant fiber material and the cluster acid catalyst increases and a long time is required to mix the mixture sufficiently.

Therefore, in order to ensure the catalytic action of the cluster acid catalyst and the function thereof as a reaction solvent at the reaction temperature in the hydrolysis process, that is, in order to enable the cluster acid catalyst to maintain the pseudo-molten state, it is preferred that the amount of water in the reaction system satisfy the following condition. Thus, it is preferred that the amount of water in the reaction system be equal to or greater than the sum total of (A) the amount of water of crystallization necessary for the entire cluster acid catalyst present in the reaction system to be in the pseudo-molten state at the reaction temperature in the hydrolysis process and (B) the amount of water necessary for the entire amount of cellulose present in the reaction system to be hydrolyzed into glucose. It is especially preferred that the sum total of (A) and (B) be added. This is because where extra water is added, the produced saccharide and cluster acid are dissolved in the extra water and a process of separating the saccharide and the cluster acid becomes difficult. Prior to the additional charging of the plant fiber material that is charged additionally, the amount (B) of water is the amount (B1) of water that is necessary to hydrolyze into glucose the entire amount of cellulose contained in the plant fiber material that is hydrolyzed initially, and after the additional charging of the plant fiber material, the amount (B) of water is the amount (B1+B2) that is necessary to hydrolyze into glucose the entire amount of cellulose contained in the plant fiber material that is hydrolyzed additionally and the subsequently added plant fiber material. As for the amount (B) of water, the total amount (B1+B2) may be added before the additional charging of the plant fiber material, or B1 and B2 may be added separately correspondingly to the additional charging of the plant fiber material.

In the hydrolysis process, the amount of water in the reaction system decreases and the amount of water of crystallization of the cluster acid catalyst also decreases. As a result, the cluster acid catalyst can become solid and the degree of contact with the plant fiber material and mixing ability of the reaction system can degrade. The occurrence of such problems can be avoided by increasing the hydrolysis temperature so that the cluster acid catalyst is brought into the pseudo-molten state. Furthermore, it is preferred that the desired amount of water of crystallization of the cluster acid catalyst can be ensured even when the relative humidity of the reaction system is decreased by heating in the hydrolysis process. Specifically, a method can be used by which a saturated vapor pressure state is produced at the hydrolysis reaction temperature inside a pre-sealed reaction container, so that the atmosphere of the reaction system at a predetermined reaction temperature is under the saturated vapor pressure, the temperature is lowered to condensate the vapors, while maintaining the sealed state, and the condensed water is added to the plant fiber material and cluster acid catalyst. Furthermore, in a case where the plant fiber material containing moisture is used, it is preferred that the amount of moisture contained in the plant fiber material also be taken into account as the amount of moisture present in the reaction system; this is not particularly necessary in a case where the dry plant fiber material is used.

When the hydrolysis reaction of the plant fiber material has advanced and the viscosity of the heated mixture has decreased, the plant fiber material is additionally charged. The viscosity of the heated mixture can be measured directly with a viscometer (for example, a shear sound resonator or the like) disposed inside the reaction container, or determined indirectly from the torque of the stirring blade that mixes the heated mixture, height of the liquid measured by the liquid level meter disposed inside the reaction container, and the relationship between the rotation and torque of the stirring blade. The viscosity of the heated mixture at the time the plant fiber material is additionally charged is not limited to a specific value, provided that it is lower than the viscosity of the heated mixture including the cluster acid catalyst in the pseudo-molten state and the plant fiber material at the initial stage of the reaction of the hydrolysis process and that the heated mixture can be mixed despite the additional charging of the plant fiber material to the heated mixture. The viscosity of the heated mixture at which the plant fiber material is to be additionally charged may be appropriately determined correspondingly to the amount of the plant fiber material that will be additionally charged. Thus, where a small amount is to be additionally charged, the additional charging can be performed when the viscosity has somewhat decreased, and where a large amount is to be additionally charged, the additional charging is performed after waiting till the hydrolysis reaction advances sufficiently and the viscosity degreases significantly. In any case, it is preferred that the additional charging be performed so as not to exceed the viscosity of the heated mixture at the initial stage of the reaction when the fiber material is initially added. Usually, it is preferred that the plant fiber material be additionally charged after the viscosity of the heated mixture has decreased to or below 1500 cp, preferably equal to or below 1200 cp, and even more preferably equal to or below 1000 cp.

The amount of the plant fiber material that is additionally charged is not particularly limited and can be determined appropriately, provided that it is within a range in which mixing ability of the heated mixture after the additional charging of the plant fiber material can be ensured. From the standpoint of processing efficiency of the plant fiber material, it is usually preferred that the volume ratio of the subsequently added plant fiber material to the cluster acid catalyst that is used in the hydrolysis process be equal to or higher than 60%. The additional charging of the plant fiber material may be performed in a plurality of cycles. Thus, it is possible to repeat a process in which the plant fiber material is additionally charged after the viscosity of the heated mixture has decreased after the previous additional charging of the plant fiber material.

Figure 3:
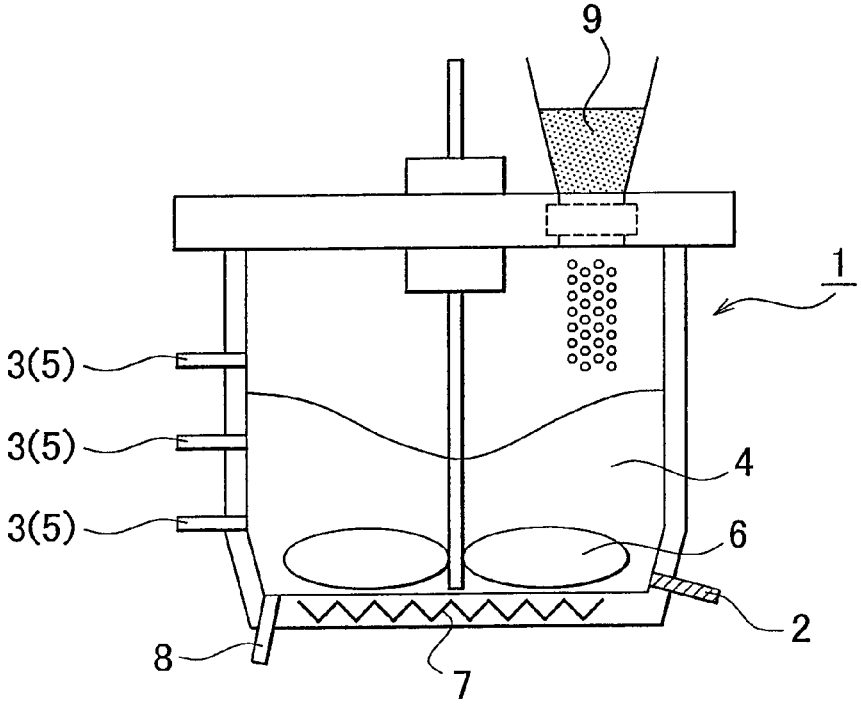
FIG. 3 is schematic diagram illustrating an embodiment of a batch-type reaction device that can be used in a hydrolysis process.

The additional charging of the fiber material in the hydrolysis process can be easily controlled by feedback returning the variations in viscosity of the heated mixture that are measured by the above-described viscometer, torque of the stirring blade, liquid level meter, or the like, to the mechanism for charging the plant fiber material and additionally charging the plant fiber material to the heated mixture when the viscosity of the heated mixture decreases. More specifically, for example, in a case of a fixed reaction apparatus (batch type) shown in FIG. 3, the viscosity of a heated mixture 4 located in a reaction container 1 can be measured with a viscosity sensor 2 and liquid level sensor 3. The viscosity sensor 2 that measures the viscosity of the heated mixture 4 is preferably disposed at the bottom surface of the reaction container 1 or in a position close to the bottom surface on the side. Furthermore, where a plurality of liquid level sensors 3 are disposed at the side surface of the reaction container 1, variations in the liquid level of the heated mixture 4 inside the reaction container 1 can be accurately measured. In this case, by providing a plurality of temperature sensors 5 together with the liquid level sensors 3, it is possible to perform adequate feedback control of the rotation speed of the stirring blade (see FIG. 3). As described above, variations in viscosity of the heated mixture 4 that are measured with the viscosity sensor 2 and liquid level sensor 3 are preferably feedback returned to a charging mechanism 9 of the plant fiber material. In the arrangement shown in FIG. 3, a heating heater 7 and a temperature sensor 8 are disposed at the bottom surface of the reaction container 1, and the temperature of the heated mixture 4 located in the reaction container 1 can be controlled. Furthermore, the configuration of the fixed reaction apparatus (batch type) is not limited to that shown in FIG. 3. For example, as described hereinabove, the viscosity of the heated mixture 4 may be measured indirectly from the torque of the stirring blade 6.

Figure 4:
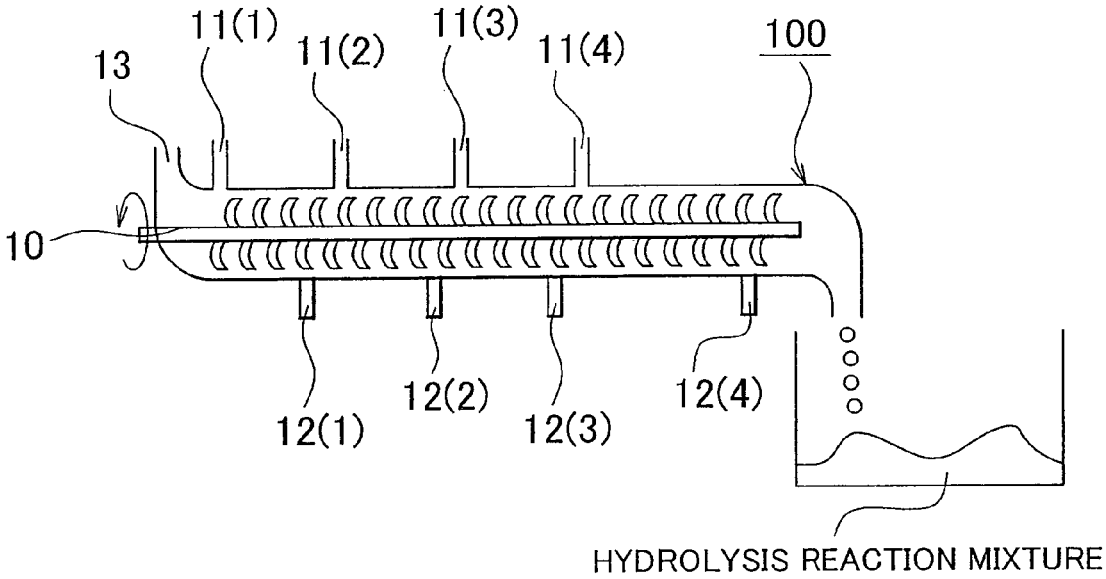
FIG. 4 is a schematic diagram of a flow-through reaction apparatus that is used in the hydrolysis process of Example 3.

FIG. 4 shows an embodiment of a flow-through reaction apparatus. In a cylindrical reaction container 100 having a stirring mechanism (a stirring blade 10) shown in FIG. 4, a plurality of charging ports 11(1) to 11(4) for the plant fiber material and viscosity sensors 12(1) to 12(4) are disposed in the flow direction downstream of a charging port 13 for the cluster acid catalyst in the pseudo-molten state. The additional charging period or additionally charged amount of the plant fiber material to be charged from the charging ports 11 can be determined from the viscosity of the heated moisture that is measured by the viscosity sensor 12 provided downstream for the positions where the charging ports 11 are disposed. In this case, the reaction can be easily controlled in the hydrolysis process by feedback returning the variations in viscosity of the heated mixture that are measured with the viscosity sensors 12 to the additional charging period or additionally charged amount of the plant fiber material that will be additionally charged from the charging ports 11. The disposition locations of the viscosity sensors 12 and charging ports 11 are not particularly limited. For example, the viscosity sensor 12(1) can be disposed adjacently to and upstream of the charging port 11(2) that is disposed downstream of the charging port 11(1) (see FIG. 4). The charging ports 11(2) and 11(3) and the viscosity sensors 12(2) and 12(3) are similarly disposed. In a flow-through reaction apparatus, in a case where a plant fiber material including lignin is used, a heteropoly acid or produced saccharide is not removed immediately before the charging ports 11, but the upstream residue is preferably removed by disposing a filter that can remove the lignin.

The advantage of lowering the reaction temperature in the hydrolysis process is that the energy efficiency can be increased. Selectivity of glucose production in the hydrolysis of cellulose contained in the plant fiber material varies depending on the hydrolysis process. The reaction efficiency generally rises as the reaction temperature rises. For example, as described in Japanese Patent Application No. 2007-115407, in the hydrolysis reaction of cellulose using phosphotungstic acid with a ratio of water of crystallization of 160%, the reaction ratio R at a temperature of 50 to 90° C. rises with the increase in temperature and almost the entire cellulose reacts at about 80° C. The glucose yield shows a similar trend to increase at 50 to 60° C., reaches a peak at 70° C. and then decreases. Thus, glucose is produced with high selectivity at 50 to 60° C., but at 70 to 90° C., reactions other than glucose production also proceed, such as production of other saccharides such as xylose and formation of decomposition products. Therefore, the reaction temperature of hydrolysis is an important factor that governs the selectivity of cellulose reaction ratio and selectivity of glucose production, and it is preferable that the hydrolysis reaction temperature be low in view of energy efficiency. However, it is preferred that the temperature of hydrolysis reaction be determined by taking into account also the cellulose reaction ratio and glucose production selectivity.

As described above, temperature conditions in the hydrolysis process may be appropriately determined with consideration for several factors (for example, reaction selectivity, energy efficiency, cellulose reaction ratio, etc.), but from the standpoint of balance of energy efficiency, cellulose reaction ratio, and glucose yield, the temperature of equal to or lower than 140° C. is usually preferred, and the temperature of equal to or lower than 120° C. is especially preferred. Depending on the form of the plant fiber material, a low temperature of equal to or lower than 100° C. can be also used. In this case, glucose can be produced with especially high energy efficiency.

The pressure in the hydrolysis process is not particularly limited, but because the catalytic activity of the cluster acid catalyst with respect to the cellulose hydrolysis reaction is high, the cellulose hydrolysis can be advanced with good efficiency even under mild pressure conditions such as a range from a normal pressure (atmospheric pressure) to 1 MPa.

Because the mixture including the cluster acid catalyst and the plant fiber material in the hydrolysis process has a high viscosity, for example, a ball mill using heating can be advantageously used, but a typical stirring device may be also used.

The duration of the hydrolysis process is not particularly limited and may be appropriately set according to the shape of the plant fiber material used, ratio of the plant fiber material and the cluster acid catalyst, catalytic activity of the cluster acid catalyst, reaction temperature, reaction pressure, and the like.

Where the temperature of reaction system decreases after the end of hydrolysis is decreased, the saccharide produced in the hydrolysis process becomes an aqueous saccharide solution when water, which dissolved the saccharide, is present in the hydrolysis reaction mixture including the cluster acid catalyst, and where no water is present, the saccharide precipitates and is contained in the solid state. Part of the produced saccharide can be present in the form of aqueous solution and the balance can be contained in the form of a mixture in the solid state. Because the cluster acid catalyst is also soluble in water, where a sufficient amount of water is contained in the mixture after the hydrolysis process, the cluster acid catalyst is also dissolved in water.

A saccharide separation process in which the saccharide (mainly including glucose) produced in the hydrolysis process and the cluster acid catalyst are separated will be described below. In the glycosylating and separating method in accordance with the invention, a method for separating the saccharide and the cluster acid is not limited to the below-described method.

The reaction mixture after the hydrolysis process (can be also referred to hereinbelow as "hydrolysis reaction mixture") includes at least the cluster acid catalyst and the produced saccharide. In a case where the amount of water in the hydrolysis process is a sum total of the (A) and (B), the saccharide of the hydrolysis reaction mixture precipitates. Meanwhile, the cluster acid catalyst also becomes a solid state when temperature decreases. Depending on the type of the plant fiber material used, a residue (unreacted cellulose or lignin, etc.) is contained as a solid component in the hydrolysis reaction mixture.

The cluster acid catalyst shows solubility in organic solvents in which the saccharide mainly including glucose, is insoluble or has poor solubility. Therefore, it is possible to add an organic solvent that is a poor solvent for the saccharide and a good solvent for the chister acid catalyst to the hydrolysis reaction mixture, perform stirring, selectively dissolve the cluster acid catalyst in the organic solvent, and then separate the organic solvent solution containing dissolved cluster acids and a solid component including the saccharide by solid-liquid separation. Depending on the plant fiber material used, a residue or the like can be contained in the solid component including the saccharide. A method for separating the organic solvent solution and the solid component is not particularly limited, and a typical solid-liquid separation method such as decantation and filtration can be used.

The organic solvent is not particularly limited, provided that it is a good solvent for the cluster acid catalyst and a poor solvent for saccharide, but in order to suppress the dissolution of the saccharide in the organic solvent, it is preferred that solubility of the saccharide in the organic solvent be equal to or less than 0.6 g/100 ml, and more preferably equal to or less than 0.06 g/100 ml. In this case, in order to increase the recovery ratio of the cluster acid catalyst, it is preferred that the solubility of the cluster acid in the organic solvent be equal to or greater than 20 g/100 ml, more preferably equal to or greater than 40 g/100 ml.

Specific examples of the organic solvent include alcohols such as ethanol, methanol, n-propanol, and octanol and ethers such as diethylether and diisopropylether. Alcohols and ethers can be advantageously used, and among them, from the standpoint of dissolution ability and boiling point, ethanol and diethylether are preferred. Diethylether does not dissolve saccharides such as glucose and has high ability of dissolving cluster acids. Therefore, diethylether is one of optimum solvents for separating saccharides and cluster acid catalysts. Ethanol also hardly dissolves saccharides such as glucose and has high ability of dissolving cluster acids. Therefore, it is also one of the optimum solvents. Diethylether is superior to ethanol in terms of distillation, but the advantage of ethanol is that it is easier obtainable than diethylether.

The amount of the organic solvent used differs depending on the ability of the solvent to dissolve the saccharide and the cluster acid catalyst and the amount of moisture contained in the hydrolysis reaction mixture. Therefore, the suitable amount of the organic solvent may be appropriately determined.

It is usually preferred that the stirring of the hydrolysis reaction mixture and the organic solvent be performed within a temperature range of from room temperature to 60° C., the specific temperature depending on the boiling point of the organic solvent. The stirring method of the hydrolysis reaction mixture and the organic solvent is not particularly limited and the stirring may be performed by a typical method. From the standpoint of recovery efficiency of the cluster acid, stirring and grinding with a ball mill is preferred as the stirring method.

In order to increase the recovery ratio of the saccharide and cluster acid and increase the purity of the obtained saccharide, it is preferred that the organic solvent (the organic solvent that is a poor solvent for the saccharide and a good solvent for the cluster acid catalyst) be added to and stirred with the solid component obtained by the aforementioned solid-liquid separation, thereby performing washing with the organic solvent. This is because the cluster acid catalyst that has been admixed to the solid component can be removed and recovered. A mixture in which the organic solvent is added to the solid component can be separated into the solid component and the organic solvent solution including the cluster acid by solid-liquid separation in the same manner as in the hydrolysis reaction mixture. If necessary, the solid component can be washed with the organic solvent a plurality of times. By adding water such as distilled water to the solid component obtained by solid-liquid separation with water, stirring and then performing solid-liquid separation (because the saccharide is soluble in water), it is possible to separate the aqueous saccharide solution from the solid component including the residue or the like.

By removing the organic solvent from the liquid component (organic solvent solution including the cluster acid catalyst dissolved therein) obtained by the solid-liquid separation, it is possible to separate the cluster acid catalyst and the organic solvent and recover the cluster acid catalyst. A method for removing the organic solvent is not particularly limited. Examples of suitable methods include vacuum distillation, freeze drying, and evaporation drying. Among them, vacuum distillation at a temperature of equal to or less than 50° C. is preferred. The recovered cluster acid catalyst can be again used as the hydrolysis catalyst for the plant fiber material. The organic solvent solution including the recovered cluster acid after washing the solid component obtained by the aforementioned solid-liquid separation can be again used for washing the organic component.

Depending on the amount of moisture in the hydrolysis process, the hydrolysis reaction mixture can contain an aqueous solution including the saccharide and cluster acid dissolved therein. In this case, the solid component including the saccharide and the organic solvent including the cluster acid catalyst dissolved therein can be separated by removing the moisture from the hydrolysis reaction mixture to precipitate the dissolved saccharide and cluster acid and then adding the organic solvent, stirring and performing solid-liquid separation. It is especially preferred that the amount of moisture in the hydrolysis reaction mixture be adjusted so that the ratio of water of crystallization in the entire cluster acid catalyst contained in the hydrolysis reaction mixture be less than 100%. In a case where the cluster acid catalyst has a large amount of water of crystallization, typically the amount for water of crystallization that is equal to or greater than the standard amount of water of crystallization, the saccharide that is a products is dissolved in the excess moisture, and the recovery ratio of saccharide is decreased by admixing the saccharide to the liquid phase including the organic solvent solution including the cluster acid. By reducing the ratio of water of crystallization in the cluster acid catalyst to less than 100%, it is possible to prevent the saccharide from thus admixing to the cluster acid catalyst.

A method that can decrease the amount of moisture in the hydrolysis reaction mixture may be used for reducing the ratio of water of crystallization in the cluster acid catalyst contained in the hydrolysis reaction mixture. Examples of such a method include a method by which the sealed state of the reaction system is released and heating is performed to evaporate the moisture contained in the hydrolysis mixture and a method by which a desiccating agent or the like is added to the hydrolysis mixture and moisture contained in the hydrolysis mixture is removed.

A method for preparing the cluster acid catalyst in a cluster state will be explained below. Conversion of the cluster acid catalyst into a cluster state is enhanced, for example, by stirring the cluster acid in a pseudo-molten state, or adding the cluster acid to a solvent and stirring under heating, or stirring the cluster acid together with the plant fiber material under heating and causing the cluster acid to act as a hydrolysis catalyst. The following three specific methods can be used for enhancing the conversion into a cluster state. (1) A method including a process of heating and stirring a cluster acid catalyst and an organic solvent that can dissolve the cluster acid catalyst; (2) a method by which in a hydrolysis process in which a plant fiber material is hydrolyzed using a cluster acid catalyst, part of the plant fiber material in an amount that can be charged in one batch is stirred under heating with the cluster acid catalyst in a pseudo-molten state and hydrolysis of the plant fiber material is performed; and (3) a method for heating and stirring a cluster acid catalyst in a pseudo-molten state. These methods (1) to (3) will be described below.

In the method (1), which includes a process of heating and stirring a cluster acid catalyst and an organic solvent that can dissolve the cluster acid catalyst, the heating temperature may be appropriately set according to the variation in the state of the cluster acid in the solvent, but a temperature of equal to or higher than 30° C. is usually preferred. From the standpoint of preventing the cluster acid catalyst from recrystallizing, it is preferred that the temperature be equal to or lower than 65° C., in particular equal to or lower than 55° C. Examples of organic solvents that can dissolve the cluster acid catalyst include organic solvents that can be used in the above-described saccharide separation process. Among them, from the standpoint of dissolution ability of the cluster acid and boiling point of an organic solvent, ethanol and methanol are preferred. The mixing ratio of the organic solvent and the cluster acid catalyst is not particularly limited and can be appropriately selected correspondingly to the solubility of the cluster acid catalyst in the organic solvent. The heating and stirring time may be appropriately determined correspondingly to the solubility of the cluster acid catalyst in the organic solvent used and the heating temperature, and usually the heating and stirring time is about 10 min to 60 min or about 30" min to 60 min. The mixing method is not particularly limited and a well-known method can be used.

Even in a case where an unused novel cluster acid reagent is used, such heating and stirring of the cluster acid catalyst and the organic acid can convert the cluster acid catalyst into a cluster state and inhibit dehydration reaction of the saccharide in the hydrolysis process. Furthermore, clustering of the reused cluster acid catalyst can be enhanced by adding the organic solvent to the hydrolysis reaction mixture and stirring in the saccharide separation process, and then heating and stirring the organic solvent solution including the cluster acid obtained by solid-liquid separation.

The cluster acid catalyst subjected to the clustering enhancing treatment can be separated by removing the organic solvent from the mixture of the cluster acid catalyst and the organic solvent after heating and stirring. In this case, by quickly removing the organic solvent, it is possible to maintain easily the cluster state of the cluster acid catalyst. More specifically, it is preferred that the organic solvent be removed by vacuum distillation, freeze drying, or the like. The organic solvent can be also removed by heating, but from the standpoint of maintaining the cluster state of the cluster acid, it is preferred that the organic solvent be removed at a low temperature (more specifically, at a temperature of equal to or lower than 65° C.), and it can be said that the aforementioned vacuum distillation and freeze drying are preferred.

Furthermore, clustering of the added cluster acid catalyst and reused cluster acid catalyst can be also enhanced by adding an organic solvent to a hydrolysis reaction mixture and stirring in the saccharide separation process, then adding a cluster acid catalyst in a crystalline state (unused cluster acid reagent or the like) to the organic solvent solution including the cluster acid obtained by solid-liquid separation, and stirring under heating. In addition to repeatedly recovering and reusing the cluster acid catalyst, even in a case where the recovered amount of the cluster acid has reduced, it is possible to perform a clustering treatment of the cluster acid catalyst in a crystalline state by adding the cluster acid catalyst in a crystalline state, and using the saccharide separation process, thereby replenishing the loss of the cluster acid catalyst in the saccharide separation process.

(2) In the method by which part of the plant fiber material in an amount that can be charged in one batch is stirred under heating with the cluster acid catalyst in a pseudo-molten state and hydrolysis of the plant fiber material is performed in a hydrolysis process, by hydrolyzing only part of the plant fiber material that can be charged in one batch, it is possible to reduce the amount of monosaccharide that can be dehydrated by the cluster acid catalyst at the initial stage of the hydrolysis process and enhance the clustering of the cluster acid catalyst. After the cluster acid catalyst has becomed the cluster state, the remaining plant fiber material is additionally charged, thereby making it possible to inhibit the hyperreaction of the saccharide produced from the additionally charged plant fiber material.

"The plant fiber material in an amount that can be charged in one batch" as referred to herein is the amount that enables the mixture to become a completely homogeneous mixed and kneaded state when this amount is mixed with the cluster acid catalyst (amount used in the hydrolysis process) in a pseudo-molten state that is used in the hydrolysis process. In this case, the plant fiber material in the mixture is not in a dry state. Because the amount of the plant fiber material that can be charged in one batch changes depending on the type of the kneading machine, this amount cannot be determined uniquely, but it is generally preferred that the weight ratio (plant fiber material:cluster acid catalyst) of the plant fiber material in an amount that can be charged in one batch and the cluster acid catalyst in a pseudo-molten state that is used in the hydrolysis process be 1:2 to 1:6. Furthermore, "part of the plant fiber material in an amount that can be charged in one batch" as referred to herein is part of the aforementioned "plant fiber material in an amount that can be charged in one batch" and is not limited to a specific amount. Usually it is a very small amount such that the viscosity of the cluster acid catalyst in the pseudo-molten state prior to the addition is maintained even after this amount of the plant fiber material is added to and stirred with the cluster acid catalyst in the pseudo-molten state. Where such very small amount of plant fiber material is initially added to the cluster acid catalyst that is used in the hydrolysis process, the effect of increasing the reaction efficiency as a whole by such so to speak sacrifice can be expected. A specific amount of the "part of the plant fiber material in an amount that can be charged in one batch" is preferably equal to or less than 10 wt. %, in particular equal to or less than 5 wt. % of the plant fiber material in an amount that can be charged in one batch.

The hydrolysis time of the portion of the plant fiber material is not particularly limited and can be set by taking the decrease in viscosity of the hydrolysis mixture as an indicator.

Usually, the hydrolysis time is about 10 min to 300 min, or 60 min to 300 min. Other conditions such as reaction time and pressure can be similar to those of the hydrolysis process.

By conducting hydrolysis of this portion of the plant fiber material with the cluster acid catalyst it is possible to convert the cluster acid catalyst into a cluster state and inhibit the dehydration reaction of saccharide in the hydrolysis process, while reducing the amount of monosaccharide dehydrated by the cluster acid catalyst to a minimum even in a case where an unused cluster acid reagent is used. Furthermore, because the clustering treatment of the cluster acid can be implemented by using the hydrolysis process, the increase in difficulty of the manufacturing process can be inhibited.

The method (3) of heating and stirring the cluster acid catalyst in a pseudo-molten state is typically a method by which the cluster acid catalyst is heated and brought to a pseudo-molten state before the plant fiber material and the cluster acid catalyst are mixed in the hydrolysis process, and then heating and stirring are performed. Typically the cluster acid catalyst is changed to a pseudo-molten state, heated and stirred in a reaction container for use in the hydrolysis process and clustering treatment is performed, and then the plant fiber material is added and the hydrolysis process is implemented.

The heating temperature is not particularly limited, provided that the cluster acid can maintain the pseudo-molten state, and can be appropriately set according to the type of cluster acid and ratio of water of crystallization. In order to perform clustering of the cluster acid catalyst with good efficiency, it is preferred that heating be conducted at a temperature that is by at least 10 to 30° C., more preferably by at least 10 to 20° C., even more preferably by at least 5 to 10° C. higher than a temperature at which the cluster acid catalyst initially becomes the pseudo-molten state.

The cluster acid catalyst is preferably heated and stirred with water in an amount such that the ratio of water of crystallization of the cluster acid catalyst becomes equal to or higher than 100%. It is especially preferred that the cluster acid catalyst be heated and stirred with water in an amount such that the ratio of water of crystallization of the cluster acid catalyst becomes equal to or higher than 100%, water that is necessary for hydrolysis of the plant fiber material in the subsequent hydrolysis process, and water ensuring the presence of saturated water vapor in the dead volume of the reactor. This is because heating and stirring in the presence of water enhances the transition of the cluster acid catalyst into the pseudo-molten state, thereby enhancing clustering.

The heating and stirring time can be set by taking the decrease in viscosity of the hydrolysis mixture as an indicator. Usually, the heating and stirring time may be about 60 to 300 min. The process of heating and stirring the cluster acid in the pseudo-molten state can be easily included as a preliminary preparatory process for the hydrolysis process using the cluster acid in the pseudo-molten state as a hydrolysis catalyst in the already existing process. Furthermore, the dehydration reaction of monosaccharide in the hydrolysis process can be inhibited even when an unused cluster acid reagent is used.

Whether the clustering of the cluster acid catalyst has advanced can be determined, for example, by infrared (IR) measurements, Raman spectroscopy, nuclear magnetic resonance (NMR), and the like.

For example, in IR measurements, the determination can be made by observing a spectrum of water (the aforementioned water of crystallization) that is coordinated to the cluster acid and comparatively evaluating the intensity of absorption peak (in the vicinity of 3200 $cm^{-1}$) derived from $H_2O$ molecule bound in a crystal and an absorption peak (in the vicinity of 3500 $cm^{-1}$) derived from an OH group bound to a strongly acidic substrate. More specifically, when an IR spectrum of the cluster acid catalyst before the clustering enhancing treatment and an IR spectrum of the cluster acid catalyst after the clustering enhancing treatment are compared, in a case where a peak intensity in the vicinity of 3200 $cm^{-1}$ that is derived from $H_2O$ molecule bound in a crystal of the cluster acid catalyst after the clustering enhancing treatment is less than that of the cluster acid catalyst before the clustering enhancing treatment, and a peak intensity in the vicinity of 3500 $cm^{-1}$ that is derived from an OH group bound to a strongly acidic substrate of the cluster acid catalyst after the clustering enhancing treatment is greater than that of the cluster acid catalyst before the clustering enhancing treatment, it can be determined that clustering has advanced. In IR measurements, the absorption peak derived from an $H_2O$ molecule is not limited to the absorption of the absorption peak derived from OH groups bound to a strongly acidic substrate and generally can be observed as a broad peak.

Furthermore, in Raman spectroscopy, for example, where the attention is focused on symmetrical stretching vibrations of a $WO_6$ octahedron of phosphotungstic acid, a sharp high scattering peak is observed in the vicinity of 985 $cm^{-1}$ in the cluster acid catalyst in a crystalline state before the clustering treatment. However, in the cluster acid catalyst in a cluster state after the clustering treatment, a shift to a higher frequency in the vicinity of 1558 $cm^{-1}$ occurs, and the peak intensity decreases significantly, that is, sensitivity decreases. Such shift to a higher frequency and decrease in sensitivity are caused by the below-described structural changes induced by clustering of the cluster acid catalyst. In the $WO_6$ octahedron, because the ion radius of W is as small as 0.074 nm, the spacing between the W and O is extremely tight, as shown in FIG. 1. Where surface energy is stabilized by clustering and the shape is deformed closer to the spherical shape, the symmetry of $WO_6$ decreases and the distance between W and O becomes even shorter. As a result, the decrease in sensitivity and increase in bonding strength cause simultaneous scattering and shift to a higher frequency. This phenomenon is not intrinsic to phosphotungstic acid and similarly occurs in other cluster acids. Therefore, the cluster state of the cluster acid catalyst can be confirmed by observing structural changes in the cluster acid catalyst by Raman spectroscopy.

EXAMPLES

Quantitative determination of D-(+)-glucose and D-(+)-xylose was conducted by high-performance liquid chromatography (HPLC) post-label fluorescence detection method. The cluster acid was identified and quantitatively determined by inductively coupled plasma (ICP).

Example 1

Distilled water was placed in advance in a sealed reaction container (batch type; see FIG. 3), the temperature was raised to a predetermined reaction temperature (70° C.), a saturated vapor pressure state was obtained inside the container, and water vapor was caused to adhere to the inner surface of the container. Then, 1 kg of a repeatedly used heteropoly acid in a cluster state (amount of water of crystallization has been measured in advance; phosphotungstic acid) and distilled water (35 g) in an amount representing shortage of water (water of a saturated vapor pressure component at 70° C. was excluded) with respect to the sum total of the amount necessary to bring water of crystallization of the heteropoly acid to 100% and the amount of water (55.6 g) necessary to hydrolyze cellulose and obtain glucose were charged into the container and heated and stirred. When the temperature inside the container reached 70° C., stirring was further continued for 10 min. Then, 0.5 kg of cellulose was charged and mixing was conducted under heating at 70° C. In 10 min after the mixing under heating was started, the viscosity was 3000 cp. In 1 h, the viscosity of the heated mixture decreased to 700 cp. Therefore, 0.5 kg of cellulose and water (55.6 g) in an amount necessary to hydrolyze the cellulose into glucose were charged and mixing under heating at 70° C. was continued for 2 h. The heating was then stopped, the container was opened, and the hydrolysis reaction mixture is cooled to room temperature, while discharging extra water vapor.

A total of 500 ml of ethanol that was twice used for washing was then added to the hydrolysis reaction mixture located inside the container, stirring was conducted for 30 min, followed by filtration that yielded a first filtrate and a first filtered material. The first filtrate (ethanol solution of heteropoly acid) was recovered. A total of 500 ml of ethanol that was once used for washing was further added to the filtered material and stirring was conducted for 30 min, followed by filtration that yielded a second filtrate and a second filtered material. A total of 500 ml of new ethanol was added to the second filtered material and stirring was conducted for 30 min, followed by filtration that yielded a third filtrate and a third filtered material. Distilled water was added to the obtained third filtered material and stirring was conducted for 10 min. No residue could be confirmed to be present in the obtained aqueous solution, but the solution was still filtered and an aqueous saccharide solution was obtained. The yield of monosaccharides (a sum total of glucose, xylose, arabinose, mannose, and galactose) was calculated from the obtained aqueous saccharide solution. The result was 85.3%. The yield of monosaccharides was calculated in the following manner.

Yield of monosaccharides (%): a ratio (weight ratio) of a sum total of actually recovered monosaccharides to a theoretic amount of produced monosaccharides that are produced when the entire amount of charged cellulose is converted into monosaccharides.

Example 2

Distilled water was placed in advance in a sealed reaction container (batch type; see FIG. 3), the temperature was raised to a predetermined reaction temperature (70° C.), a saturated vapor pressure state was obtained inside the container, and water vapor was caused to adhere to the inner surface of the container. Then, 1.15 kg of a repeatedly used heteropoly acid in a cluster state (amount of water of crystallization has been measured in advance; phosphotungstic acid) and distilled water (35 g) in an amount representing shortage of water (water of a saturated vapor pressure component at 70° C. was excluded) with respect to the sum total of the amount necessary to bring water of crystallization of the heteropoly acid to 100% and the amount of water (55.6 g) necessary to hydrolyze cellulose and obtain glucose were charged into the container and heated and stirred. When the temperature inside the container reached 70° C., stirring was further continued for 10 min. Then, 0.5 kg of wood chips containing lignin was charged and mixing was conducted under heating at 70° C. In 10 min after the mixing under heating was started, the viscosity was 3000 cp. In 3 h, lignin was removed from the obtained heated mixture by using a sintered filter. The viscosity of the heated mixture from which lignin had been removed decreased to 700 cp. Therefore, 0.5 kg of wood chips containing lignin and water (35 g) necessary to hydrolyze the cellulose contained in the wood chips into glucose were charged and mixing under heating at 70° C. was continued for 3 h.

The heating was then stopped, the container was opened, and the hydrolysis reaction mixture is cooled to room temperature, while discharging extra water vapor. The separation of monosaccharides and heteropoly acid was then performed in the same manner as in Example 1. Distilled water was added to the obtained third filtered material and stirring was conducted for 10 min. A residue containing lignin was confirmed to be present in the obtained aqueous solution, and an aqueous saccharide solution was obtained by filtration. The yield of monosaccharides was calculated from the obtained aqueous saccharide solution. The result was 80.2%. In this case, the yield of monosaccharides was calculated under an assumption that lignin removed with the sintered filter and lignin removed by filtration from the aqueous solution took 30 wt. % (that is, 300 g) of the used wood. In the present example, when lignin was removed with the sintered filter, heteropoly acid that had been adsorbed on the lignin was removed together with lignin. This is why the amount of the heteropoly acid used was by a factor 1.15 larger than that of Example 1.

Example 3

A flow-through reactor (see FIG. 4) was used in which stirring can be performed in a heating line (constant temperature of 70° C.) with respect to a main channel of heteropoly acid (phosphotungstic acid) in a pseudo-molten state. A stirring blade 10 in the line has a structure that is effective only for stirring and practically does not affect the conveying of the contents in a reaction tank 100. Therefore, the conveying speed of the contents is a sum total of charging speeds of components (heteropoly acid, plant fiber material). In the reaction tank 100, a charging port 13 of the heteropoly acid in the pseudo-molten state is on the upstream most side, and a plurality of charging ports 11 (first to fourth charging port) for the plant fiber material are provided downstream of the charging port 13 for the hetero poly acid. Viscosity sensors 12 (first to fourth viscosity sensors) are provided downstream of the charging port 11 for the plant fiber material (directly in front of the charging port provided downstream of this charging port or directly in front of the downstream wall of the reactor), and the viscosity of the contents inside the reaction tank 100 that is determined by the viscosity sensors 12 is used for feedback controlling the amount of plant fiber material charged from the charging ports 11 for the plant fiber material.

Wood chips (containing lignin) were charged from the first charging port 11(1), while charging into the reaction tank 100 a heteropoly acid (repeatedly used, in a cluster state) in a pseudo-molten state to which water of hydrolysis was added in advance. In this case, the charging speed of the wood chips was half the charging speed of heteropoly acid. The charging speed of the heteropoly acid and the charging speed of the wood chips from the first charging port 11(1) were adjusted to obtain a viscosity in the first viscosity sensor 12(1) of 700 cp. The charging speed from the second to fourth charging ports 11(2) to 11(4) was also adjusted to obtain a viscosity in the second to fourth viscosity sensors 12(2) to 12(4) of 700 cp. The reaction mixture discharged downstream of the reactor was cooled to room temperature, while extra water vapor was removed. In the present example, the weight ratio of the heteropoly acid and wood chips used was 1:1.2 (heteropoly acid:wood chips). Saccharides and the heteropoly acid were then recovered from the hydrolysis reaction mixture in the same manner as in Example 1. The yield of monosaccharides was 82.1%. In this case, the yield of monosaccharides was calculated under an assumption that the removed lignin took 30 wt. % of the used wood chips.

Comparative Example 1

Distilled water was placed in advance in a sealed reaction container (batch type), the temperature was raised to a predetermined reaction temperature (70° C.), a saturated vapor pressure state was obtained inside the container, and water vapor was caused to adhere to the inner surface of the container. Then, 1 kg of a repeatedly used heteropoly acid in a cluster state (amount of water of crystallization has been measured in advance; phosphotungstic acid) and distilled water (35 g) in an amount representing shortage of water (water of a saturated vapor pressure component at 70° C. was excluded) with respect to the sum total of the amount necessary to bring water of crystallization of the heteropoly acid to 100% and the amount of water (55.6 g) necessary to hydrolyze cellulose and obtain glucose were charged into the container and heated and stirred. Once the temperature inside the container reached 70° C., stirring was further continued for 5 min. Then, 0.5 kg of cellulose was charged and mixing was conducted for 2 h under heating at 70° C. The heating was then stopped, the container was opened, and cooling was performed to room temperature, while discharging extra water vapor. Monosaccharides and heteropoly acid were then recovered from the hydrolysis reaction mixture in the same manner as in Example 1. The yield of monosaccharides was 85.3%.

RESULTS. The yield of monosaccharides and weight ratio of the heteropoly acid and fiber material obtained in Examples 1 to 3 and Comparative Example 1 are shown in Table 1.

TABLE 1

| | Monosaccharide yield | Heteropoly acid:fiber material (weight ratio) |
|---|---|---|
| Example 1 | 85.3% | 1:2 |
| Example 2 | 86.5% | 1.15:2 |
| Example 3 | 86.2% | 1:1.2 |
| Comparative Example 1 | 85.3% | 2:1 |

As shown in Table 1, in Examples 1 to 3, the amount of heteropoly acid used per unit weight of the fiber material could be greatly reduced with respect to that of Comparative Example 1, while maintaining the yield of monosaccharides. Furthermore, the comparison of Example 1 and Comparative Example 1 (both use a batch-type reactor), in Example 1, the processed amount of fiber material per unit weight of heteropoly acid doubled. Therefore, the energy required for heating that is necessary to bring the heteropoly acid into the pseudo-molten state could be reduced. Furthermore, in Example 3 that used a continuous reaction apparatus, the amount of heteropoly acid used could be reduced and heating energy could be also reduced. In an industrial reaction apparatus, where water is added to the reaction system by introducing steam, the operations of heating and addition of water can be conducted simultaneously, such a process being superior to introduction of distilled water in terms of energy.

The invention claimed is:

1. A method for hydrolyzing a plant fiber material and producing and separating a saccharide including glucose, comprising:

a hydrolysis process of using a cluster acid catalyst in a pseudo-molten state to hydrolyze cellulose contained in the plant fiber material and produce glucose, wherein in the hydrolysis process, the cluster acid catalyst and a first amount of the plant fiber material that increases a viscosity of the cluster acid catalyst in a pseudo-molten state when added to the cluster acid catalyst in a pseudo-molten state are heated and mixed, and a second amount of the plant fiber material is then further added when the decrease in viscosity of a heated mixture the cluster acid catalyst and the first amount of the plant fiber material occurs.

2. The method according to claim 1, wherein a volume ratio of the first amount of the plant fiber material to the cluster acid catalyst is equal to or greater than 60%.

3. The method according to claim 1, wherein a volume ratio of the second amount of the plant fiber material to the cluster acid catalyst is equal to or greater than 60%.

4. A method for hydrolyzing a plant fiber material and producing and separating a saccharide including glucose, comprising:

a hydrolysis process of using a cluster acid catalyst in a pseudo-molten state to hydrolyze cellulose contained in the plant fiber material and produce glucose, wherein in the hydrolysis process, the plant fiber material is added when a viscosity of a mixture of the cluster acid catalyst and the plant fiber material becomes a first predetermined value, and then the addition of the plant fiber material is stopped when the viscosity of the mixture becomes a second predetermined value that is larger than the first predetermined value.

* * * * *